US010452008B2

(12) United States Patent
Hashiguchi et al.

(10) Patent No.: US 10,452,008 B2
(45) Date of Patent: Oct. 22, 2019

(54) IMAGE FORMING APPARATUS

(71) Applicant: CANON KABUSHIKI KAISHA, Tokyo (JP)

(72) Inventors: Shinji Hashiguchi, Mishima (JP); Ryo Suzuki, Kashiwa (JP); Yasuhisa Matsumoto, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/134,337

(22) Filed: Sep. 18, 2018

(65) Prior Publication Data

US 2019/0086845 A1 Mar. 21, 2019

(30) Foreign Application Priority Data

Sep. 21, 2017 (JP) ..... 2017-181190

(51) Int. Cl.
*G03G 15/20* (2006.01)

(52) U.S. Cl.
CPC ..... *G03G 15/2039* (2013.01); *G03G 2215/00721* (2013.01)

(58) Field of Classification Search
None
See application file for complete search history.

(56) References Cited

U.S. PATENT DOCUMENTS

2016/0223974 A1* 8/2016 Shida ..... G03G 15/2039

FOREIGN PATENT DOCUMENTS

| | | |
|---|---|---|
| JP | 2003-084619 A | 3/2003 |
| JP | 2011-027885 A | 2/2011 |
| JP | 2013-037159 A | 2/2013 |
| JP | 2014-032236 A | 2/2014 |
| JP | 2016-139075 A | 8/2016 |
| JP | 2017-097224 A | 6/2017 |

* cited by examiner

*Primary Examiner* — Clayton E. LaBalle
*Assistant Examiner* — Jas A Sanghera
(74) *Attorney, Agent, or Firm* — Canon U.S.A. Inc., IP Division

(57) ABSTRACT

An image forming apparatus includes a position deviation detection unit configured to detect a position deviation of a recording medium in a width direction of the recording medium in a current job on a basis of (a) an amount of change over time in a difference between temperature detected by a first temperature detection element and temperature detected by a second temperature detection element and (b) information on temperature distribution on a fixing unit that occurred before the current job.

16 Claims, 5 Drawing Sheets

IMAGE FORMING APPARATUS

BACKGROUND OF THE INVENTION

Field of the Invention

The present disclosure generally relates to an image forming apparatus such as a copier or a printer based on electrophotography.

Description of the Related Art

An electrophotographic image forming apparatus includes a fixing unit that fixes a toner image to a recording medium by heating. A fixing unit has an area which a recording medium does not pass through. Since the recording medium does not take the heat away from this area, the temperature of the sheet non-passing part of the fixing unit rises. To prevent the temperature of the fixing member from rising due to the increased temperature of the sheet non-passing part, Japanese Patent Laid-Open No. 2003-084619 discloses a technique of decreasing productivity (the number of sheets printable within predetermined time) when the temperature of the sheet non-passing part reaches a predetermined temperature.

However, in a case where a recording medium that is being conveyed is deviated from a predetermined position in the direction of the longitudinal of the fixing unit (a state in which the recording medium is shifted to one side or skewed to one side, hereinafter collectively referred to as "shifted-to-one-side state"), the deviation might produce a part at which the temperature rises more than expected in relation to the detection temperature of a temperature detection element, and the fixing member might be damaged by heat, resulting in poor image quality, etc.

To address this condition, Japanese Patent Laid-Open Nos. 2011-027885 and 2016-139075 disclose that the following approaches are employed in an image forming apparatus. In Japanese Patent Laid-Open No. 2011-027885, the shift to one side is detected solely on the basis of the difference in temperature between temperature detection elements provided on a fixing member. In Japanese Patent Laid-Open No. 2016-139075, the difference in temperature between temperature detection elements at the timing of entry of a recording medium into a fixing nip is taken as a base difference, and the shift to one side is detected on the basis of a change over time in the difference in temperature between the temperature detection elements during printing.

However, the result of detection based solely on the difference in temperature between temperature detection elements as disclosed in Japanese Patent Laid-Open No. 2011-027885 contains factors other than the temperature difference arising from shifting to one side, for example, individual differences and variations among temperature detection elements, non-uniformity in heat distribution of a fixing member, and the like. For this reason, its precision in detecting a shifted-to-one-side state is low.

The control disclosed in Japanese Patent Laid-Open No. 2016-139075, in which factors other than the temperature difference arising from shifting to one side are taken into consideration, makes it possible to detect a shifted-to-one-side state if no temperature history remains before the start of printing. However, if the last job (the last printing) was done in a shifted-to-one-side state, the detection precision decreases because the shift to one side in the last job is not taken into consideration. That is, the following determination error will occur in a case where shifting to one side occurred in a previous job before the current job and where there is no change in the shifted-to-one-side state in the current job: it will be erroneously determined that there is no shift to one side because, in the current job, the change over time in the difference between the temperature detected by the first temperature detector and the temperature detected by the second temperature detector is zero.

Moreover, the difference in temperature between temperature detection elements varies depending on the width of a recording medium. This is because the distribution of temperature at a sheet non-passing part varies depending on the width of a recording medium when the temperature rises at the sheet non-passing part.

If a shifted-to-one-side state is not detected properly in a case of shifting to one side, a fixing member might be damaged by heat due to an abnormal increase in temperature. On the other hand, productivity decreases if it is erroneously detected as a shifted-to-one-side state when it is actually not.

SUMMARY OF THE INVENTION

An image forming apparatus disclosed herein is capable of detecting a shifted-to-one-side state with high precision irrespective of print history and the width of a recording medium, thereby preventing an abnormal increase in the temperature of a fixing member and keeping productivity high. A fixing device that achieves the same is also disclosed.

An image forming apparatus includes an image forming unit, a fixing unit, and a position deviation detection unit. The image forming unit forms a toner image on a recording medium. The fixing unit applies heat to the toner image formed on the recording medium so as to fix the toner image to the recording medium. The fixing unit includes a first temperature detection element and a second temperature detection element. The first temperature detection element detects temperature of the fixing unit. The second temperature detection element also detects temperature of the fixing unit. The second temperature detection element is provided at a position different from a position where the first temperature detection element is provided in a longitudinal direction of the fixing unit. The position deviation detection unit detects a position deviation of the recording medium in a width direction of the recording medium in a current job on a basis of (a) an amount of change over time in a difference between the temperature detected by the first temperature detection element and the temperature detected by the second temperature detection element and (b) information on temperature distribution on the fixing unit which occurred before the current job.

Further features of the present disclosure will become apparent from the following description of exemplary embodiments with reference to the attached drawings.

DESCRIPTION OF THE EMBODIMENTS

With reference to the accompanying drawings, some embodiments will now be explained. However, the description below, including but not limited to description about the material, shape, and relative arrangement of components, shall not be construed to restrict the scope of the present disclosure to any specific example, unless otherwise specified.

First Embodiment

Image Forming Apparatus

Figure 1:
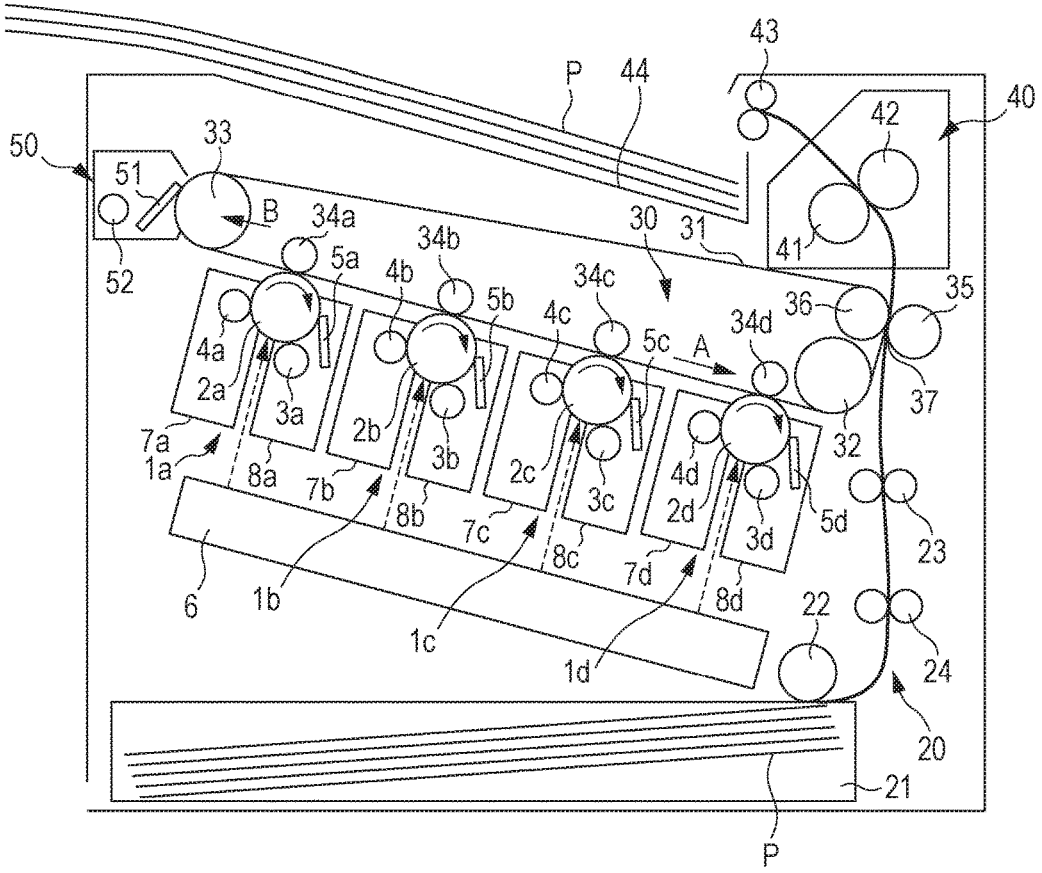
FIG. 1 is a cross-sectional view of an image forming apparatus according to exemplary embodiments.

First, with reference to a schematic cross-sectional view of FIG. 1, the overall structure of an image forming apparatus will now be explained in conjunction with its image forming operation. An image forming apparatus according to the present embodiment is a color laser printer using a transfer-type electrophotographic process with the maximum process speed of 135 mm/s and throughput (the number of sheets printable per minute) of 30 ppm (A4-size Long Edge Feed (landscape), hereinafter abbreviated as LEF). The maximum width of a recording medium (recording paper, transfer medium) that is passable is 297 mm (A4-size LEF or A3-size Short Edge Feed (portrait), hereinafter abbreviated as SEF). The minimum width of it is 76 mm.

Detachable toner cartridges 1*a*, 1*b*, 1*c*, and 1*d* are provided in the body of the image forming apparatus. Though these four toner cartridges 1*a*, 1*b*, 1*c*, and 1*d* have the same structure, they are different in that toner of different colors, specifically, yellow, magenta, cyan, and black, are used for forming images. The toner cartridges 1*a*, 1*b*, 1*c*, and 1*d* include development units 7*a*, 7*b*, 7*c*, and 7*d* and image bearer units 8*a*, 8*b*, 8*c*, and 8*d* respectively.

The former, each development unit 7*a*, 7*b*, 7*c*, 7*d*, includes a corresponding development roller 4*a*, 4*b*, 4*c*, 4*d*. The latter, each image bearer unit 8*a*, 8*b*, 8*c*, 8*d*, includes a photosensitive drum 2*a*, 2*b*, 2*c*, 2*d*, a charging roller 3*a*, 3*b*, 3*c*, 3*d*, a drum cleaning blade 5*a*, 5*b*, 5*c*, 5*d*, and a waste toner container, correspondingly.

A scanner unit 6 is provided under the toner cartridges 1*a*, 1*b*, 1*c*, and 1*d*. The scanner unit 6 performs exposure based on an image signal for each of the photosensitive drums 2*a*, 2*b*, 2*c*, and 2*d*.

Each of the photosensitive drums 2*a*, 2*b*, 2*c*, and 2*d* is charged to a predetermined negative potential level by the corresponding one of the charging rollers 3*a*, 3*b*, 3*c*, and 3*d*. After the charging, an electrostatic latent image is formed thereon each by the scanner unit 6. The electrostatic latent image is reversal-developed by the corresponding one of the development units 7*a*, 7*b*, 7*c*, and 7*d* for adhesion of toner that is negative in polarity. In this way, toner images of yellow, magenta, cyan, and black are formed respectively.

An intermediate transfer belt unit 30 includes an intermediate transfer belt 31 stretched on a drive roller 32, an opposite secondary transfer roller 36, and a tension roller 33, with tension applied by the tension roller 33 in the direction indicated by the arrow B. Primary transfer rollers 34*a*, 34*b*, 34*c*, and 34*d* are provided on the inside of the intermediate transfer belt 31 opposite the photosensitive drums 2*a*, 2*b*, 2*c*, and 2*d* respectively. A transfer bias is applied to each of them by a bias application device that is not illustrated.

Each of the photosensitive drums 2*a*, 2*b*, 2*c*, and 2*d* with a toner image formed thereon rotates in the direction indicated by the arrow, the intermediate transfer belt 31 turns in the direction indicated by the arrow A, and a positive bias is applied to each of the primary transfer rollers 34*a*, 34*b*, 34*c*, and 34*d*. Because of this operation, the toner images on the photosensitive drums 2*a*, 2*b*, 2*c*, and 2*d* are primarily transferred onto the intermediate transfer belt 31 sequentially. The superposed toner image of four colors, that is, in a state of being laid one on another, is conveyed to a secondary transfer nip 37.

A feeding-and-conveying device 20 includes a feeding roller 22 and conveying rollers 24. The feeding roller 22 picks up and feeds a recording medium P out of a feeding cassette 21, which contains sheets of recording medium P. The conveying rollers 24 convey the recording medium P fed therefrom. The recording medium conveyed from the feeding-and-conveying device 20 is substantially vertically conveyed to the secondary transfer nip 37 by resist rollers 23.

At the secondary transfer nip 37, a positive bias is applied to a secondary transfer roller 35, thereby secondarily transferring the toner image of four colors from the intermediate transfer belt 31 onto the recording medium P conveyed. After the transfer of the toner image, the recording medium P is conveyed to a fixing device 40. Heat and pressure are applied thereat by a fixing sleeve 41 and a pressing roller 42 so as to fix the toner image to the medium surface. The recording medium P after the fixing process is ejected onto an ejection tray 44 by ejection rollers 43.

On the other hand, after the toner image transfer process, residual toner that remains on the surface of each of the photosensitive drums 2*a*, 2*b*, 2*c*, and 2*d* is removed by the corresponding one of the drum cleaning blades 5*a*, 5*b*, 5*c*, and 5*d*. Residual toner that remains on the intermediate transfer belt 31 after the secondary transfer onto the recording medium P is removed by a cleaning blade 51 of a cleaning device 50. The removed toner is collected through a waste toner conveyance path 52 into a waste toner collection container that is not illustrated.

Fixing Device (Fixing Unit)

Next, a fixing device provided in an image forming apparatus according to the present embodiment will now be explained. With regard to a fixing member that is a constituent of the fixing device, the term "longitudinal direction" as used herein means the direction perpendicular to the recording medium conveyance direction and the recording medium thickness direction, and the term "shorter-side direction" as used herein means the direction perpendicular to the longitudinal direction (that is, the shorter-side direction means the recording medium conveyance direction). With regard to a recording medium, the term "width direction" as used herein means the direction perpendicular to the recording medium conveyance direction and the recording medium thickness direction and corresponds to the longitudinal direction of the fixing member. A cross-sectional plane of the fixing device is a section perpendicular to the longitudinal direction of the fixing member. The nip of the fixing device is a region where a recording medium with a toner image thereon is conveyed in a nipped state while being heated for fixing the toner image thereto.

Figure 2:
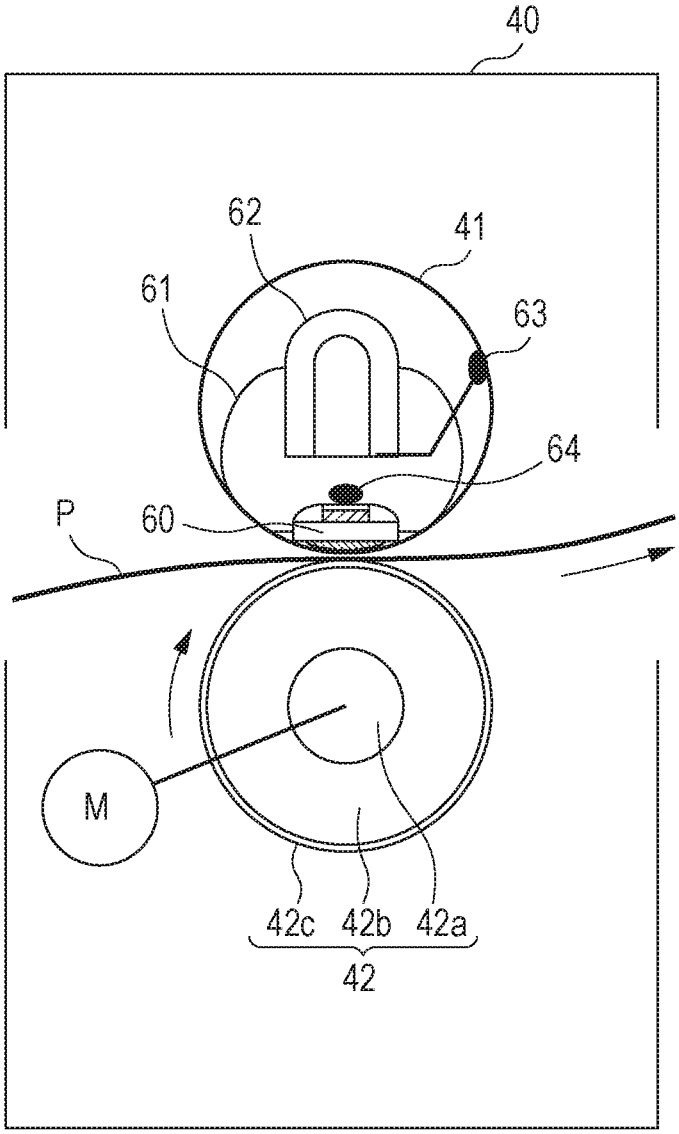
FIG. 2 is a schematic cross-sectional view of a fixing device provided in an image forming apparatus according to exemplary embodiments.
Figure 3:
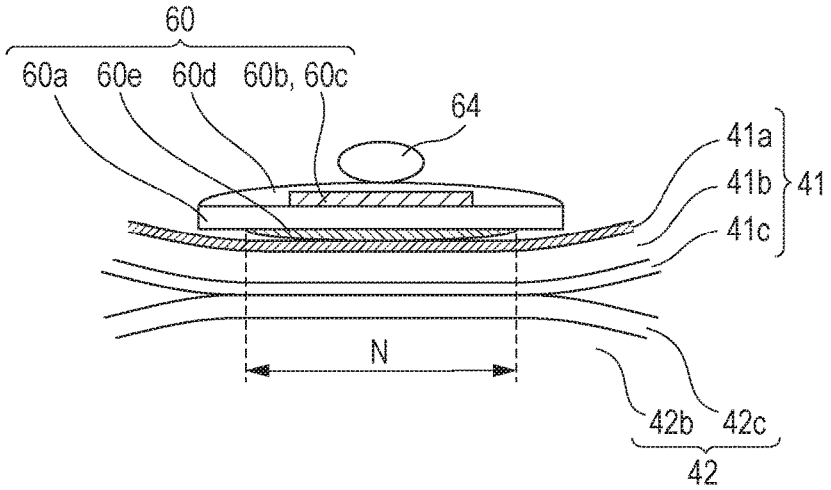
FIG. 3 is a schematic enlarged cross-sectional view of a nip, and its neighborhood, of a fixing device according to a first embodiment in a shorter-side direction.

FIG. 2 is a schematic cross-sectional view of the fixing device 40 according to the present embodiment. FIG. 3 is a schematic enlarged cross-sectional view of the nip, and its neighborhood, of the fixing device 40 in the shorter-side direction. The fixing device 40 includes the fixing sleeve 41, which is a rotatable flexible member and operates as a first fixing member, the pressing roller 42, which is a pressing member provided opposite the fixing sleeve 41 and operates as a second fixing member, and a heater 60, which operates as a heating member (heat applier). The pressing roller 42 is urged to apply a pressing force toward the heater 60 so as to form the nip N therebetween. These main components of the fixing device will now be explained in detail.

Fixing Sleeve

As illustrated in FIG. 3, the fixing sleeve 41 has the following structure. An elastic layer 41*b* is formed on the outer circumferential surface of an endless-structured base layer 41*a*. A releasing layer 41*c* is formed on the outer circumferential surface of the elastic layer 41*b*. The fixing sleeve 41 has a cylindrical shape with an outside diameter of 24 mm.

A resin-based material such as polyimide or a metal-based material such as SUS is used as the material of the base layer 41*a*. In the present embodiment, to ensure sufficient strength, an endless-structured SUS sleeve that has a thickness of approx. 30 μm is used.

For the elastic layer 41*b*, from the viewpoint of quick start, it is advantageous to use a material the thermal conductivity of which is as high as possible. In the present embodiment, silicone rubber that has a thermal conductivity of approx. 1.3 W/mK and a thickness of approx. 250 μm is used as the material of the elastic layer 41*b*.

The releasing layer 41*c* is provided for preventing an offset phenomenon from occurring due to temporary adhesion of toner onto the surface of the fixing sleeve 41 and then back onto the recording medium P. Fluoropolymer such as PTFE or PFA or silicone resin, etc. is used as the material of the releasing layer 41*c*. In the present embodiment, the releasing layer 41*c* is a PFA tube that has a thickness of approx. 30 μm, and the outer circumferential surface of the elastic layer 41*b* made of silicone rubber is covered by this PFA tube.

In FIG. 2, the numeral 61 denotes a heater holder and the numeral 62 denotes a stay.

Pressing Roller

The pressing roller 42 has the following structure. A conductive silicone rubber layer that has a thickness of approx. 3 mm is formed as an elastic layer 42*b* on the outer circumferential surface of a core 42*a* that is made of metal and has a shape of a round bar. The outer circumferential surface of the rubber layer is covered by a releasing layer 42*c* that is a PFA tube having a thickness of approx. 50 μm. The ends of the core 42*a* in the longitudinal direction are supported via non-illustrated bearings respectively by the frame of the fixing device 40 such that the pressing roller 42 is held in parallel with the heater 60. The roller part made up of the elastic layer 42*b* and the releasing layer 42*c* of the pressing roller 42 has an outside diameter of 25 mm and a length in the longitudinal direction (width in the longitudinal direction) of 325 mm.

The pressing roller 42 is driven to rotate in the direction indicated by the arrow by a driver M (FIG. 2) described later. Due to the force of friction with the pressing roller 42, the fixing sleeve 41 rotates as a slave around the heater holder 61 (FIG. 2) at the same speed of rotation as the speed of rotation of the pressing roller 42

Heater

The heater 60, which operates as a heating member, includes a substrate 60*a*. The substrate 60*a* is elongated in the longitudinal direction, which is perpendicular to the recording medium conveyance direction. The substrate 60*a* is an insulating board that is made of ceramic having high thermal conductivity such as alumina or aluminum nitride. In the present embodiment, to ensure sufficient thermal capacity and sufficient strength, a rectangular alumina board that has a thickness of 1 mm, a width of 8 mm, and a length of 375 mm is used as the substrate 60*a*.

A heat-generating resistor layer 60*b*, 60*c*, which operates as a heat generator, is formed on the back of the substrate 60*a* along the longitudinal direction of the substrate 60*a*. The heat-generating resistor layer 60*b*, 60*c* is mainly made of AgPd alloy, NiSn alloy, or RuO2 alloy, etc., and has a thickness of approx. 10 μm, a length of 310 mm, and a width of 4 mm. The heat-generating resistor layer 60*b*, 60*c* generates heat when energized electrically by a non-illustrated power supply from the two ends in the longitudinal direction.

An insulating glass layer 60*d* is formed as an overcoat layer on the heat-generating resistor layer 60*b*, 60*c*. The insulating glass layer 60*d* insulates the coated layer from external conductive members. The insulating glass layer 60*d* may have the following function or functions additionally: an anti-corrosion function of preventing the resistance value of the heat-generating resistor layer 60*b*, 60*c* from changing due to oxidation or the like, a protection function of preventing the heat-generating resistor layer 60*b*, 60*c* from being damaged mechanically, and the like. The thickness of the insulating glass layer 60*d* is approx. 30 μm.

A sliding layer 60*e* is formed on a surface of the substrate 60*a* for sliding along the inner circumferential surface of the fixing sleeve 41. The sliding layer 60*e* is made of imide-based resin such as polyimide or polyamidoitnide, etc. and has a thickness of approx. 6 μm. The sliding layer 60*e* has high heat resistance, high lubricity, and high abrasion resistance, and ensures smooth sliding along the inner circumferential surface of the fixing sleeve 41.

Temperature Detectors

Figure 4:
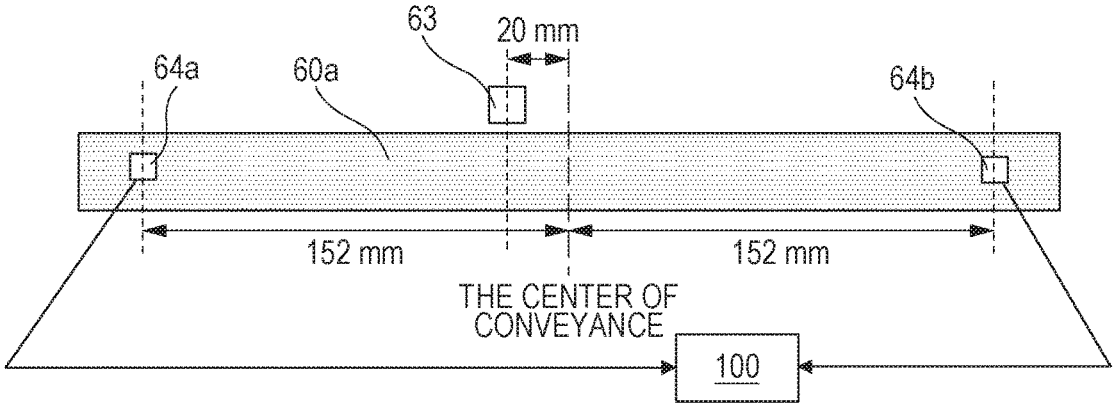
FIG. 4 is a diagram for explaining positions where temperature detection elements are arranged.

With reference to FIG. 4, the layout of temperature detection elements that operate as temperature detectors will now be explained. The temperature detection elements include a thermistor 63 for temperature control and first and second thermistors 64*a* and 64*b* for detecting a rise in temperature of the sheet non-passing part. The thermistor 63 for temperature control is in contact with the inner surface of the fixing sleeve 41 as illustrated in FIG. 2. The position of the thermistor 63 for temperature control is 20 mm away from the center of conveyance in the longitudinal direction (a position that will be inside the sheet passing area even in a case where a recording medium having the minimum width is conveyed) as illustrated in FIG. 4.

At each of the two sides with respect to the center of conveyance in the longitudinal direction, at least one thermistor is provided as the first, second thermistor 64*a*, 64*b* for detecting a rise in temperature of the sheet non-passing part, wherein each of the thermistors 64*a* and 64*b* detects a temperature varying over time. More specifically, each of the thermistors 64*a* and 64*b* is in contact with the heater 60 as illustrated in FIG. 2. The position of each of the thermistors 64*a* and 64*b* is 152 mm away from the center of conveyance in the longitudinal direction as illustrated in FIG. 4. That is, each of the thermistors 64*a* and 64*b* is provided at a position that will be inside the sheet non-passing area during A4-size LEF (recording medium width: 297 mm), which is frequently used, and during letter-size LEF (recording medium width: approx. 279 mm).

Shift-To-One-Side Detector (Position Deviation Detection Unit)

Next, a shift-to-one-side detector 100 (FIG. 4) will now be explained. The shifting of a recording medium to one side as disclosed herein means a state in which the center of the recording medium in the width direction is deviated from the center of the conveyance path, which is recommended in the engineering specs of an image forming apparatus, in the width direction of the recording medium.

In the present embodiment, the shift to one side is detected by comparing a value determined on the basis of first and second shift-to-one-side indices explained below with a threshold value, wherein the shift-to-one-side index is temperature information that indicates the degree of deviation in the width direction of the recording medium, and the threshold value is temperature information determined depending on the size of the recording medium in the width direction.

The first shift-to-one-side index is a shift-to-one-side index based on a change over time in the difference between the temperature detected by the first temperature detector and the temperature detected by the second temperature detector in the current job. The second shift-to-one-side index is a shift-to-one-side index based on a change over time in the difference between the temperature detected by the first temperature detector and the temperature detected by the second temperature detector in job history before the current job.

More specifically, in the present embodiment, it is determined as a shifted-to-one-side state (position deviation of the recording medium) in a case where shift-to-one-side index Tky defined as shown below is in excess of a threshold value corresponding to the width of the recording medium shown in Table 1 (equal to or greater than the threshold value).

$$Tky=|(Ta-Tb)-(Ta0-Tb0)+Tky\ \mathrm{pre}| \quad (1)$$

$$Tky\ \mathrm{pre}=\{(Ta0-Tb0)-(Ta0_\mathrm{cold}-Ta0_\mathrm{cold})\}\times Tkyj/Tkyj_\mathrm{pre} \quad (2)$$

Ta: Temperature detected by the thermistor 64*a* during printing in the current job Tb: Temperature detected by the thermistor 64*b* during printing in the current job Ta0: Temperature detected by the thermistor 64*a* before the entry of the first sheet of the recording medium into the fixing nip in the current job Tb0: Temperature detected by the thermistor 64*b* before the entry of the first sheet of the recording medium into the fixing nip in the current job Ta0_cold: Temperature of the thermistor 64*a* when the temperature of the thermistor 63 for temperature control reaches a predetermined temperature due to the heating of the fixing device from a sufficiently cooled state Tb0_cold: Temperature of the thermistor 64*b* when the temperature of the thermistor 63 for temperature control reaches a predetermined temperature due to the heating of the fixing device from a sufficiently cooled state Tkyj_pre: Threshold value that was set for the previous printing (Table 1)

Tkyj: Threshold value that is set for the current printing (Table 1)

In Formula (1), the term (Ta−Tb)−(Ta0−Tb0) expresses the amount of change over time in the difference between the temperature detected by the thermistor 64*a* and the temperature detected by the thermistor 64*b* after the entry of the recording medium into the nip; this term represents the shifted-to-one-side state in the current job (the current printing) only. On the other hand, Tky pre represents the history (the state of temperature distribution of the fixing unit) of the shifted-to-one-side state before the current job (the shifted-to-one-side state during previous printing).

In Formula (2), the term (Ta0−Tb0)−(Ta0_cold−Tb0_cold) expresses the temperature difference caused by the job before the current job between the position of the thermistor 64*a* and the position of the thermistor 64*b*. Correction is performed by Tkyj/Tkyj_pre for a case where the recording medium width in the current job (the current printing) is different from the recording medium width in the last job that immediately precedes the current job (the last printing that immediately precedes the current printing).

That is, {(Ta0−Tb0)−(Ta0_cold−Tb0_cold)}/Tkyj_pre represents the degree of approximation of the temperature difference between the thermistor 64*a* and the thermistor 64*b* to the threshold value at the end of the last job immediately preceding the current job (the last printing immediately preceding the current printing). The result of conversion to the shifted-to-one-side state during the current job (the current printing) is obtained by multiplying this by Tkyj. For the purpose of explanation, in the description here, it is assumed that the recording medium width was the same up to the end of the last job immediately preceding the current job, and the recording medium width in the current job is different therefrom.

An image forming apparatus according to the present embodiment includes a unit configured to store the value of Ta0_cold and the value of Tb0_cold. However, if the image forming apparatus does not include any unit configured to store the value of Ta0_cold and the value of Tb0_cold, the following modification may be adopted.

Specifically, the above term may be replaced with a term that relates to shift-to-one-side index Tky0 in the last job immediately preceding the current job and the time that has elapsed since the last job immediately preceding the current job. The longer the time that has elapsed since the last job immediately preceding the current job, the less the value of the shift-to-one-side index Tky0 in the last job immediately preceding the current job, because of natural cooling.

As another approach, the shift-to-one-side index Tky may be calculated as follows:

$$Tky=(Ta-Tb)-(Ta1-Tb1)+Tky\ \mathrm{pre} \quad (1')$$

$$Tky\ \mathrm{pre}=\{(Ta1-Tb1)-(Ta0-Tb0)\}\times Tkyj/Tkyj\ \mathrm{pre} \quad (2')$$

Ta1: Temperature detected by the thermistor 64*a* before the start of printing (the temperature detected by the thermistor 64*a* immediately before the heating of the fixing device in the current job)

Tb1: Temperature detected by e thermistor 64*b* before the start of printing (the temperature detected by the thermistor 64*b* immediately before the heating of the fixing device in the current job)

In the present embodiment, the threshold value that is temperature information to be compared for detecting a shifted-to-one-side state (Tky threshold) has been set in advance in accordance with the size of a recording medium in the width direction as shown in Table 1 below. Qualitatively speaking, the smaller the size of a recording medium in the width direction, the smaller the threshold. Quantitatively speaking, the Tky threshold is determined depending on the relation between the peak position in the temperature distribution when the temperature rises at the sheet non-passing part and the layout of the thermistors 64*a* and 64*b*. Specifically, the closer the peak position in the temperature distribution when the temperature rises at the sheet non-passing part to the position of the thermistor 64*a* (or the position of the thermistor 64*b*), the larger the threshold.

TABLE 1

| Tky threshold to be compared for detecting a shifted-to-one-side state | | | | |
|---|---|---|---|---|
| Recording medium width | 218 ≥ W | 259 ≥ W > 218 | 281.5 ≥ W > 259 | W > 281.5 |
| Tky threshold | 25° C. | 30° C. | 40° C. | 50° C. |

Figure 5:
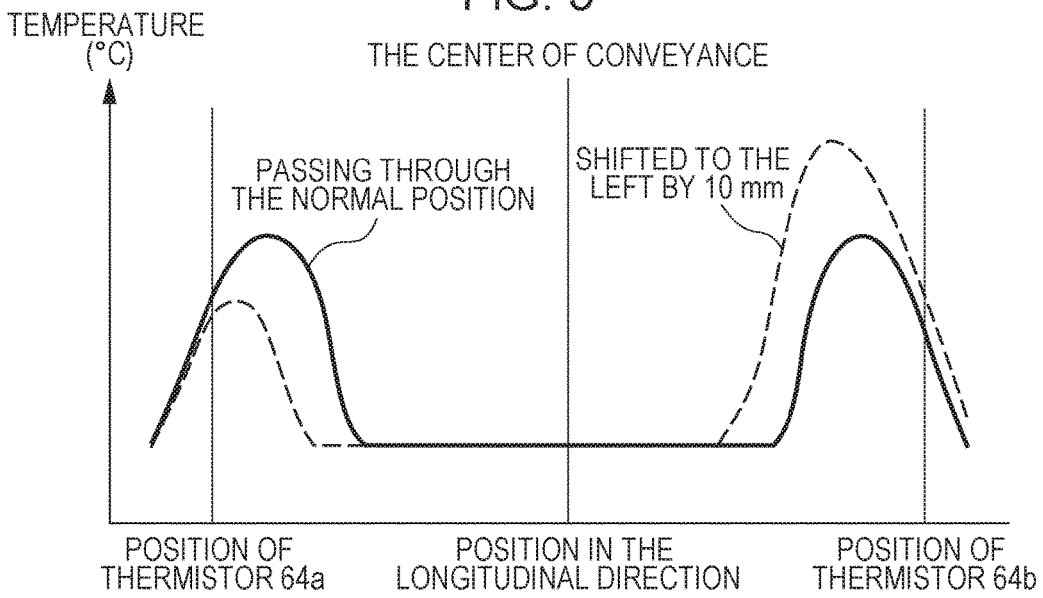
FIG. 5 is a graph of the distribution of temperature when printing is performed on a recording medium that has a width of 216 mm.

With reference to FIG. 5, the shifting of a recording medium that has a width of 216 mm (letter-size SEF) to one side will now be explained. After that, with reference to FIG. 6, the shifting of a recording medium that has a width of 279 mm (letter-size LEF) to one side will be explained.

FIG. 5 is a graph of the temperature distribution of the fixing sleeve 41 for a case where printing is performed on a recording medium that has a width of 216 mm (letter-size SEF) at the normal print position and for a case where the recording medium is shifted to the left side by a deviation of 10 mm (the occurrence of a greater rise in temperature of the sheet non-passing part on the right side). As shown by the solid curve, the temperature distribution for a case where printing is performed at the normal print position is almost bilaterally symmetrical. In addition, in this case, the peak of the temperature distribution showing the rise in temperature of the sheet non-passing part exists inside in the longitudinal direction (closer to the center) with respect to the position of each thermistor 64*a*, 64*b*, and the temperature is relatively low at the position of each thermistor 64*a*, 64*b*.

This is because the recording medium takes the heat away at the inner area in relation to the area of the rise in temperature of the sheet non-passing part and because the pressing roller and the fixing sleeve allow the heat to escape at the outer area in relation to the area of the rise in temperature of the sheet non-passing part.

In a case where the recording medium is shifted to the left side by a deviation of 10 mm, the peak temperature becomes higher on the side where the area of the rise in temperature of the sheet non-passing part becomes wider (on the right side). However, the temperature detected by the thermistor 64*b* does not increase so much because the peak position becomes more distant from the position of the thermistor 64*b*. The peak temperature becomes lower on the side where the area of the rise in temperature of the sheet non-passing part becomes narrower (on the left side). However, the temperature detected by the thermistor 64*a* does not decrease so much because the peak position becomes closer to the position of the thermistor 64*a*. That is, it is relatively difficult to detect a shifted-to-one-side state by using the thermistors if the peak position of the rise in temperature of the sheet non-passing part in a case of printing at the normal print position exists inside with respect to the thermistor position.

Figure 6:
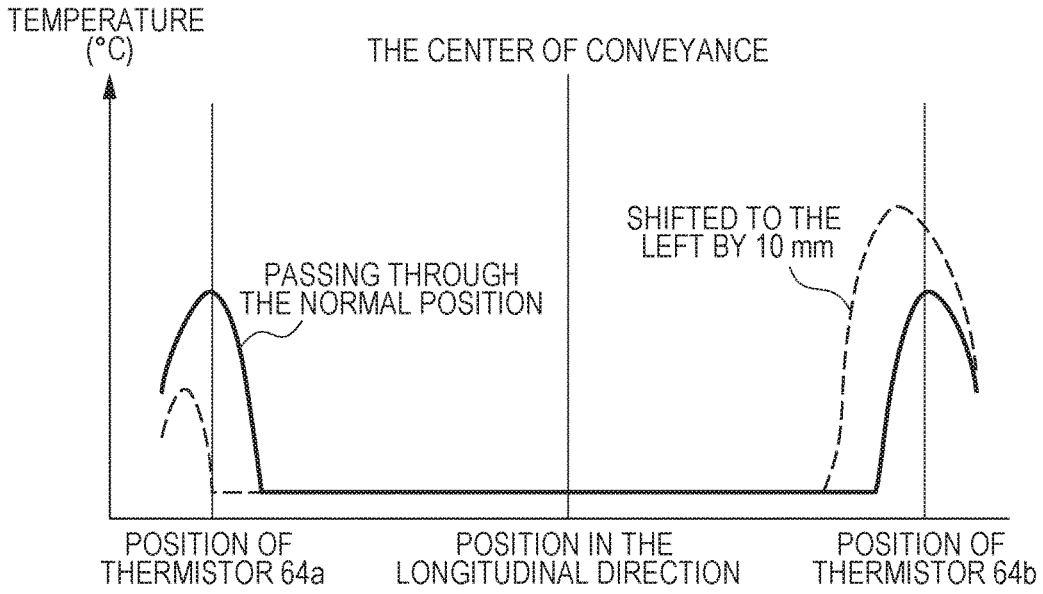
FIG. 6 is a graph of the distribution of temperature when printing is performed on a recording medium that has a width of 279 mm.

FIG. 6 is a graph of the temperature distribution of the fixing sleeve 41 for a case where printing is performed on a recording medium that has a width of 279 mm (letter-size LEF) at the normal print position and for a case where the recording medium is shifted to the left side by a deviation of 10 mm (the occurrence of a greater rise in temperature of the sheet non-passing part on the right side). As shown by the solid curve, the temperature distribution for a case where printing is performed at the normal print position is almost bilaterally symmetrical. The peak position, in the temperature distribution, of the rise in temperature of the sheet non-passing part is almost the same as the position of the thermistor 64*a*, 64*b*.

In a case where the recording medium is shifted to the left side by a deviation of 10 mm, the peak temperature becomes higher on the side where the area of the rise in temperature of the sheet non-passing part becomes wider (on the right side). The temperature at the position of the thermistor 64*b* is fairly high, although the peak position becomes different from the thermistor position. The peak temperature becomes lower on the side where the area of the rise in temperature of the sheet non-passing part becomes narrower (on the left side). The temperature detected by the thermistor 64*a* decreases, with a shift of the peak position from the position of the thermistor 64*a*.

That is, it is relatively easy to detect a shifted-to-one-side state by using the thermistors if the peak position of the rise in temperature of the sheet non-passing part in a case of printing at the normal print position exists on or in the neighborhood of the thermistor position.

In the present embodiment, each temperature detection element is arranged at the position corresponding to the peak of the rise in temperature of the sheet non-passing part for printing on a wide recording medium. In addition, as shown in Table 1, the Tky threshold, which is to be compared for detecting a shifted-to-one-side state, has been set in advance such that the following relation holds: the smaller the width of the recording medium, the smaller the threshold.

In the present embodiment, the preset threshold increases stepwise as the width of a recording medium increases, on the basis of the foregoing relation between the temperature distribution regarding the rise in temperature of the sheet non-passing part and the layout of the temperature detection elements. However, the scope of the present disclosure is not limited to this example. Depending on the relation between the temperature distribution regarding the rise in temperature of the sheet non-passing part and the layout of the temperature detection elements, the threshold may decrease as the width of a recording medium increases.

In the present embodiment, in order to prevent an abnormal increase in the temperature of the fixing member, cycle-down operation is performed if a shifted-to-one-side state is detected, wherein post-rotating operation (operation of rotating the fixing sleeve 41 in a state in which the power supply to the heater 60 is shut off) is performed, and printing is started again. However, the operation performed after detecting the shifted-to-one-side state is not limited to this example. Any measure for suppressing the increase in the temperature of the fixing member may be taken. For example, the speed of conveyance of the recording medium may be decreased. The print operation may be stopped for predetermined time. The timing of recording medium feeding may be made slower so as to increase the interval between one sheet and another of the recording medium. An alarm may be issued to let the user know the shifted-to-one-side state. It is effective to perform at least one of them.

Comparative Experiments

We conducted the following experiments for comparison and confirmation of precision in detecting a shifted-to-one-side state and damage to the fixing device. In Comparative Example 1, unlike the present embodiment, the preset threshold value to be compared for detecting a shifted-to-one-side state is constant (25° C.) irrespective of the width of the recording medium. In Comparative Example 2, the preset threshold value to be compared for detecting a shifted-to-one-side state is constant (50° C.) irrespective of the width of the recording medium. In Comparative Example 3, the calculation formula for determining the shift-to-one-side index Tky is made different from that of the present embodiment as shown below, although the threshold value to be compared for detecting a shifted-to-one-side state is not constant and is determined depending on the width of the recording medium, similarly to the present embodiment:

$Tky=|(Ta-Tb)-(Ta0-Tb0)$ (Modified from Formula (1) by deleting the term of $Tky$ pre)

The experiments were conducted under combinations of confirmation conditions shown in Table 2 below.

TABLE 2

| Confirmation conditions | | |
|---|---|---|
| Recording medium width | Amount of shift to one side | Number of print sheets |
| 216 mm | 3 mm | 50 sheets × 1 set |
| (Letter-size SEF) | 10 mm | |
| 279 mm | 3 mm | |
| (Letter-size LEF) | 10 mm | |
| 216 mm | 3 mm | 5 sheets × 10 sets |
| (Letter-size SEF) | 10 mm | Set interval: 5 seconds |
| 279 mm | 3 mm | |
| (Letter-size LEF) | 10 mm | |

The amount of shift to one side in Table 2 means the amount of deviation of the center of the recording medium from the center of the conveyance path in the width direction of the recording medium. An amount of shift to one side of 3 mm or smaller is tolerated in the engineering specs of an image forming apparatus so as to accommodate variations among parts and components. Since there is no risk of damage to the fixing member and occurrence of an image problem, for this tolerable level, it is unnecessary to detect shifting to one side. If the amount of shift to one side is 10 mm or larger, there is a risk of damage to the fixing member and occurrence of an image problem. Therefore, it is necessary to detect shifting to one side.

The results under the conditions will now be described with reference to Tables 3 and 4.

1a) Printing on fifty successive sheets of a recording medium having a width of 216 mm, with an amount of shift to one side of 10 mm In the Present Embodiment and Comparative Examples 1 and 3, the shifted-to-one-side state was detected when the shift-to-one-side index Tky reached the threshold 25° C., and cycle-down operation was performed upon detection. For this reason, the increase in the temperature of the fixing member was suppressed properly. By contrast, in Comparative Example 2, cycle-down operation was not performed because the shift-to-one-side index Tky did not reach the threshold 50° C. For this reason, the temperature of the fixing member becomes high on the side where the area of the rise in temperature of the sheet non-passing part becomes wider because of the shift to one side. Therefore, there is a risk of damage to the fixing member and occurrence of an image problem.

2a) Printing on five sheets, successively in each of ten sets (i.e., 5×10), of a recording medium having a width of 216 mm, with an amount of shift to one side of 10 mm In the Present Embodiment and Comparative Example 1, the shifted-to-one-side state was detected when the shift-to-one-side index Tky reached the threshold 25° C., and cycle-down operation was performed upon detection. For this reason, the increase in the temperature of the fixing member was suppressed properly. In Comparative Example 2, cycle-down operation was not performed because the shift-to-one-side index Tky did not reach the threshold 50° C. For this reason, the temperature of the fixing member becomes high on the side where the area of the rise in temperature of the sheet non-passing part becomes wider because of the shift to one side. Therefore, there is a risk of damage to the fixing member and occurrence of an image problem.

In Comparative Example 3, the shift-to-one-side index Tky did not reach the threshold 25° C. because the shift-to-one-side index Tky was reset for each set of printing of five successive sheets. For this reason, the temperature of the fixing membermemberbecomes high on the side where the area of the rise in temperature of the sheet non-passing part becomes wider because of the shift to one side. Therefore, there is a risk of damage to the fixing member.

3a) Printing on fifty successive sheets of a recording medium having a width of 279 mm, with an amount of shift to one side of 10 mm In the Present Embodiment and Comparative Examples 2 and 3, the shifted-to-one-side state was detected when the shift-to-one-side index Tky reached the threshold 50° C., and cycle-down operation was performed upon detection. For this reason, the increase in the temperature of the fixing member was suppressed properly. In Comparative Example 1, the apparatus went into cycle-down operation at the smaller number of print sheets because its threshold is 25° C., meaning a decrease in productivity more than necessary.

4a) Printing on five sheets, successively in each of ten sets (i.e., 5×10), of a recording medium having a width of 279 mm, with an amount of shift to one side of 10 mm In the Present Embodiment and Comparative Example 2, the shifted-to-one-side state was detected when the shift-to-one-side index Tky reached the threshold 50° C., and cycle-down operation was performed upon detection. For this reason, the increase in the temperature of the fixing member was suppressed properly. In Comparative Example 1, the apparatus went into cycle-down operation at the smaller number of print sheets because its threshold is 25° C., meaning a decrease in productivity more than necessary.

In Comparative Example 3, the shift-to-one-side index Tky did not reach the threshold 25° C. because the shift-to-one-side index Tky was reset for each set of printing of five successive sheets. For this reason, the temperature of the fixing member becomes high on the side where the area of the rise in temperature of the sheet non-passing part becomes wider because of the shift to one side. Therefore, there is a risk of damage to the fixing member and occurrence of an image problem.

The results of the experiments for the above-described cases of 10-mm shift to one side are shown in Table 3. In the present embodiment, the shift to one side is detected properly regardless of the recording medium width and the print mode. Therefore, the present embodiment reduces the risk of occurrence of an image problem caused by damage to the fixing member due to the rise in temperature. Moreover, an unnecessary decrease in productivity is prevented.

TABLE 3

| Summary of the comparative experiments (Amount of shift to one side: 10 mm) | | | | |
|---|---|---|---|---|
| | Width: 216 mm | | Width: 279 mm | |
| | 50 sheets × 1 set | 5 sheets × 10 sets | 50 sheets × 1 set | 5 sheets × 10 sets |
| Present Embodiment | ○ Detected at the 23rd sheet Threshold: 25° C. | ○ Detected at the 4th set Threshold: 25° C. | ○ Detected at the 18th sheet Threshold: 50° C. | ○ Detected at the 4th set Threshold: 50° C. |
| Comparative Example 1 | ○ Detected at the 23rd sheet Threshold: 25° C. | ○ Detected at the 4th set Threshold: 25° C. | Δ Detected at the 5th sheet Threshold: 25° C. | Δ Detected at the 1st set Threshold: 25° C. |
| Comparative Example 2 | x Not detected Threshold: 50° C. | x Not detected Threshold: 50° C. | ○ Detected at the 18th sheet Threshold: 50° C. | ○ Detected at the 4th set Threshold: 50° C. |
| Comparative Example 3: Without Tky pre | ○ Detected at the 23rd sheet Threshold: 25° C. | x Not detected Threshold: 25° C. | ○ Detected at the 18th sheet Threshold: 50° C. | x Not detected Threshold: 50° C. |

Next, the results under the conditions for an amount of shift to one side of 3 mm will now be described.

1b) Printing on fifty successive sheets of a recording medium having a width of 216 mm, with an amount of shift to one side of 3 mm In the Present Embodiment and Comparative Examples 1, 2, and 3, the shift-to-one-side index Tky did not reach the threshold 25° C. or 50° C., and no shift to one side was detected. Therefore, cycle-down operation was not performed, and printing was performed properly.

2b) Printing on five sheets, successively in each of ten sets (i.e., 5×10), of a recording medium having a width of 216 mm, with an amount of shift to one side of 3 mm In the Present Embodiment and Comparative Examples 1, 2, and 3, the shift-to-one-side index Tky did not reach the threshold 25° C. or 50° C., and no shift to one side was detected. Therefore, cycle-down operation was not performed, and printing was performed properly.

3b) Printing on fifty successive sheets of a recording medium having a width of 279 mm, with an amount of shift to one side of 3 mm In the Present Embodiment and Comparative Examples 2 and 3, the shift-to-one-side index Tky did not reach the threshold 25° C. or 50° C., and no shift to one side was detected. Therefore, cycle-down operation was not performed, and printing was performed properly. By contrast, in Comparative Example 1, the shift-to-one-side index Tky exceeded the threshold 25° C., resulting in erroneous detection as a shifted-to-one-side state. Therefore, cycle-down operation was performed. Consequently, productivity decreased.

4b) Printing on five sheets, successively in each of ten sets (i.e., 5×10), of a recording medium having a width of 279 mm, with an amount of shift to one side of 3 mm In the Present Embodiment and Comparative Examples 2 and 3, the shift-to-one-side index Tky did not reach the threshold 25° C. or 50° C., and no shift to one side was detected. Therefore, cycle-down operation was not performed, and printing was performed properly. By contrast, in Comparative Example 1, the shift-to-one-side index Tky exceeded the threshold 25° C., resulting in erroneous detection as a shifted-to-one-side state. Therefore, cycle-down operation was performed. Consequently, productivity decreased.

The results of the experiments for the above-described cases of 3-mm shift to one side are shown in Table 4. In the present embodiment, it is possible to perform printing properly without erroneous detection as a shifted-to-one-side state, regardless of the recording medium width and the print mode.

TABLE 4

| Summary of the comparative experiments (Amount of shift to one side: 3 mm | | | | |
|---|---|---|---|---|
| | Width: 216 mm | | Width: 279 mm | |
| | 50 sheets × 1 set | 5 sheets × 10 sets | 50 sheets × 1 set | 5 sheets × 10 sets |
| Present Embodiment | ○ Not detected | ○ Not detected | ○ Not detected | ○ Not detected |
| Comparative Example 1 Threshold: 25° C. | ○ Not detected | ○ Not detected | Δ Detected erroneously at the 15th sheet | Δ Detected erroneously at the 3rd set |
| Comparative Example 2 Threshold: 50° C. | ○ Not detected | ○ Not detected | ○ Not detected | ○ Not detected |
| Comparative Example 3: Without Tky pre | ○ Not detected | ○ Not detected | ○ Not detected | ○ Not detected |

As explained above, in the present embodiment, the formula of the shift-to-one-side index includes the term Tky pre for taking job history before the current job (previous job print history) into consideration, and the threshold for determination as a shifted-to-one-side state is changed depending on the width of the recording medium. By this means, it is possible to detect a shifted-to-one-side state with high precision and prevent an image problem from occurring due to damage to the fixing member.

Second Embodiment

Next, a second embodiment will now be explained. The structure of an image forming apparatus and a fixing device according to the present embodiment is the same as that of the first embodiment explained above with reference to FIGS. 1, 2, and 3. Therefore, it is not explained here. The arrangement of the temperature detection elements according to the present embodiment is also the same as the arrangement illustrated in FIG. 4. Therefore, it is not explained here.

Figure 7:
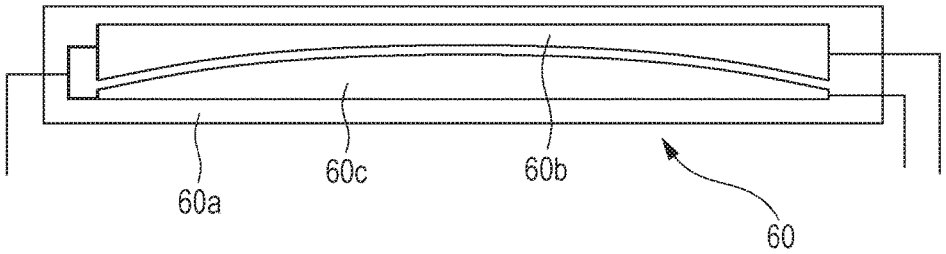
FIG. 7 is a diagram for explaining the shape of heat generators of a heater according to a second embodiment.

In the present embodiment, the heater 60 includes a plurality of heat generators that differ in heat distribution from each other. With reference to FIG. 7, the shape of the substrate 60*a*, the heat-generating resistor layer 60*b*, and the heat-generating resistor layer 60*c* of the heater 60 will now be explained. The width in the heater's shorter-side direction of the heat-generating resistor layer 60*b*, which is an example of a first heat-generating resistor whose amount of heat generation at each end portion is smaller than amount of heat generation at a center portion in the heater's longitudinal direction, decreases gradually from each end portion toward the center portion in the heater's longitudinal direction. The width in the heater's shorter-side direction of the heat-generating resistor layer 60*c*, which is an example of a second heat-generating resistor whose amount of heat generation at each end portion is larger than amount of heat generation at a center portion in the heater's longitudinal direction, increases gradually from each end portion toward the center portion in the heater's longitudinal direction.

Power supply to the heat-generating resistor layer 60*b* and power supply to the heat-generating resistor layer 60*c* can be controlled independently of each other. It is possible to adjust the heat distribution by changing the ratio of power supply to the heat-generating resistor layer 60*b* to power supply to the heat-generating resistor layer 60*c* (energization percentage) in accordance with an instruction from a non-illustrated controller.

Figure 8:
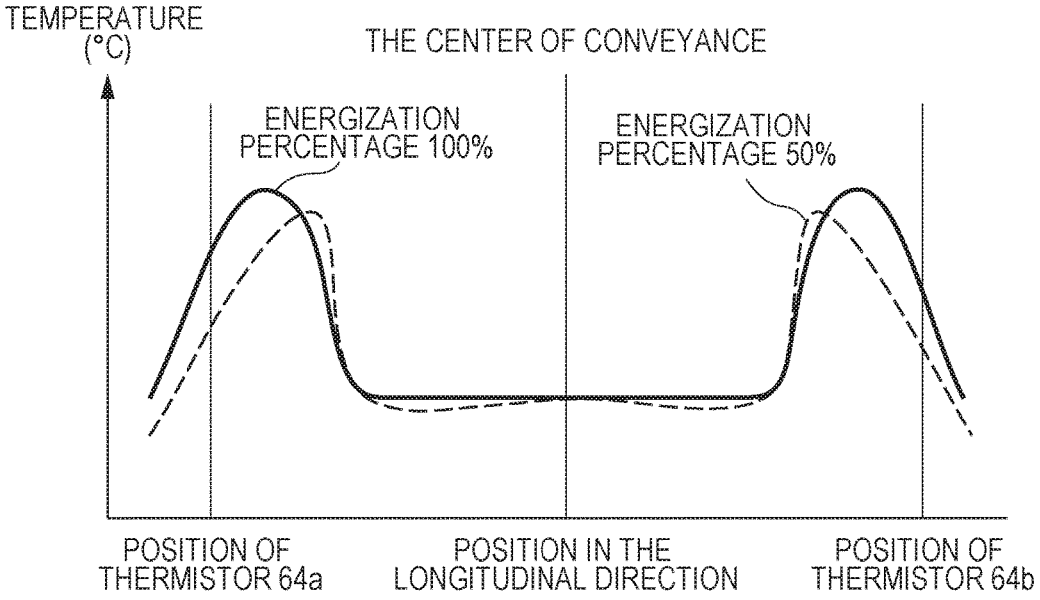
FIG. 8 is a graph of the distribution of temperature when printing is performed on a recording medium that has a width of 216 mm, according to a second embodiment.

FIG. 8 is a graph of the temperature distribution of the fixing sleeve 41 for a case where printing is performed on a recording medium that has a width of 216 mm (letter-size SEF) at the normal print position, with a change in energization percentage (the amount of power to the heat-generating resistor layer 60*c* in relation to the amount of power to the heat-generating resistor layer 60*b*).

As compared with the temperature distribution for energization percentage 100%, in the temperature distribution for energization percentage 50%, the peak position of the rise in temperature of the sheet non-passing part is shifted inward, and temperature at the position of the thermistor 64*a*, 64*b* is lower. As explained earlier in the first embodiment, if the peak position of the rise in temperature of the sheet non-passing part in a case of printing at the normal print position is away from the thermistor position, it is relatively difficult to detect a shifted-to-one-side state. To compensate for this difficulty, as shown in Table 5, the Tky threshold, which is to be compared for detecting a shifted-to-one-side state, has been set in advance such that the following relation holds: the lower the energization percentage, the smaller the threshold.

TABLE 5

Tky threshold to be compared for detecting a shifted-to-one-side state

| | | Recording medium width | | | |
|---|---|---|---|---|---|
| | | 218 ≥ W | 259 ≥ W > 218 | 281.5 ≥ W > 259 | W > 281.5 |
| Energization percentage | 100% | 25° C. | 30° C. | 40° C. | 50° C. |
| | 80% | 22° C. | 27° C. | 37° C. | 47° C. |
| | 50% | 20° C. | 25° C. | 35° C. | 45° C. |
| | 0% | 15° C. | 20° C. | 30° C. | 40° C. |

As explained above, with the present embodiment, even in a case where the heater is able to change the heat distribution in the longitudinal direction, it is possible to detect a shifted-to-one-side state with high precision by changing the Tky threshold to be compared for detecting a shifted-to-one-side state in accordance with the heat distribution in the longitudinal direction. This prevents an image problem from occurring due to damage to the fixing member.

VARIOUS EXAMPLES

Although some embodiments are described above, the scope of the present disclosure is not limited to the above embodiments. Various modifications can be made within a range not departing from the gist of the present disclosure.

Variation Example 1

In the foregoing embodiments, it is explained that a shifted-to-one-side state is not detected for an amount of shift to one side of 3 mm or smaller. However, the scope of the present disclosure is not limited thereto. The amount of shift to one side may always be detected (detected even if the amount of shift to one side is 3 mm or smaller), and cycle-down operation, etc. may be performed earlier if, for example, it is detected that the shift to one side is on the increase.

Variation Example 2

In the foregoing embodiments, it is explained that the first and second thermistors 64*a* and 64*b* for detecting a rise in temperature of the sheet non-passing part are in contact with the heater 60. However, the scope of the present disclosure is not limited thereto. Specifically, the first and second thermistors 64*a* and 64*b* may be in contact with at least one of the first and second fixing members (the fixing sleeve 41 and the pressing roller 42).

In the foregoing embodiments, it is explained that the thermistor 63 for temperature control is in contact with the inner surface of the fixing sleeve 41 inside the area of the minimum width of a recording medium that is passable. However, the thermistor 63 for temperature control may be in contact with the heater 60 inside the area of the minimum width of a recording medium that is passable.

Variation Example 3

In the foregoing embodiments, the heater 60 that is in contact with the inner surface of the fixing sleeve 41 is used as a heating member for heating the nip. However, the scope of the present disclosure is not limited thereto. A halogen heater that is not in contact with the inner surface of the fixing sleeve 41 may be used instead of the heater 60.

Variation Example 4

In the foregoing embodiments, recording paper is mentioned as a recording medium. However, a recording medium according to the present disclosure is not limited to paper. In general, a recording medium is a sheet-shaped object on which a toner image is formed by an image forming apparatus. It includes, for example, standard-sized or non-standard-sized plain paper, thick paper, thin paper, an envelope, a postal card, a sticker, a resin sheet, an OHP sheet, glossy paper, and the like. In the foregoing embodiments, for the purpose of explanation, paper-related terms and words such feeding are used for describing the processing/operation of a recording medium (sheet) P. However, the use of them shall not be construed to limit the recording medium to paper.

Variation Example 5

In the foregoing embodiments, a fixing device that fixes, to a sheet, a toner image that has not been fixed yet is taken as an example. However, the scope of the present disclosure is not limited thereto. The present disclosure can be applied also to a device that applies heat and pressure to a toner image that has been temporarily fixed to a sheet (referred to as fixing device in this case, too).

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority of Japanese Patent Application No. 2017-181190 filed Sep. 21, 2017, which is hereby incorporated by reference herein in its entirety.

What is claimed is:

1. An image forming apparatus, comprising:

an image forming unit configured to form a toner image on a recording medium;

a fixing unit configured to apply heat to the toner image formed on the recording medium so as to fix the toner image to the recording medium, the fixing unit including a first temperature detection element configured to detect temperature of the fixing unit and including a second temperature detection element configured to detect temperature of the fixing unit, the second temperature detection element being provided at a position different from a position where the first temperature detection element is provided in a longitudinal direction of the fixing unit; and a position deviation detection unit configured to detect a position deviation of the recording medium in a width direction of the recording medium in a current job on a basis of (a) an amount of change over time in a difference between the temperature detected by the first temperature detection element and the temperature detected by the second temperature detection element and (b) information on temperature distribution on the fixing unit which occurred before the current job.

2. The image forming apparatus according to claim 1, wherein the position deviation detection unit detects the position deviation of the recording medium by comparing, with a threshold, a value determined on a basis of (a) a difference between the temperature detected by the first temperature detection element and the temperature detected by the second temperature detection element before entry of the recording medium into the fixing unit, (b) a difference between the temperature detected by the first temperature detection element and the temperature detected by the second temperature detection element during passing of the recording medium through the fixing unit, and (c) the information on the temperature distribution, and wherein the threshold is set in accordance with a size of the recording medium in the current job.

3. The image forming apparatus according to claim 2, wherein, the smaller the size of the recording medium, the smaller the threshold.

4. The image forming apparatus according to claim 2, wherein the first temperature detection element is provided at one end area of the fixing unit, and the second temperature detection element is provided at an opposite end area of the fixing unit in the longitudinal direction of the fixing unit.

5. The image forming apparatus according to claim 4, wherein the fixing unit includes a film that has a cylindrical shape and a heater that is in contact with an inner surface of the film, and wherein the first temperature detection element and the second temperature detection element are in contact with the heater.

6. The image forming apparatus according to claim 5, wherein the fixing unit includes a third temperature detection element for temperature control provided between the first temperature detection element and the second temperature detection element in the longitudinal direction, and wherein the third temperature detection element is in contact with the inner surface of the film.

7. The image forming apparatus according to claim 5, wherein the fixing unit includes a pressing roller configured to form, together with the heater, a fixing nip, with the film sandwiched therebetween, and wherein the recording medium with the toner image thereon undergoes fixing processing while being conveyed in a nipped state at the fixing nip.

8. The image forming apparatus according to claim 5, wherein the heater includes a plurality of heat generators controllable independently of each other, and wherein the heater is able to change heat distribution in the longitudinal direction by adjusting a ratio of power supplied to the plurality of heat generators.

9. The image forming apparatus according to claim 8, wherein the heater includes a first heat generator configured to generate a larger amount of heat at an area where the recording medium of relatively small size passes and a second heat generator whose heat distribution is different from heat distribution of the first heat generator, and wherein, the smaller the ratio of power supplied to the second heat generator to power supplied to the first heat generator, the smaller the threshold.

10. An image forming apparatus, comprising:

an image forming unit configured to form a toner image on a recording medium;

a fixing unit configured to apply heat to the toner image formed on the recording medium so as to fix the toner image to the recording medium, the fixing unit including a first temperature detection element configured to detect temperature of the fixing unit and including a second temperature detection element configured to detect temperature of the fixing unit, the second temperature detection element being provided at a position different from a position where the first temperature detection element is provided in a longitudinal direction of the fixing unit; and a position deviation detection unit configured to detect a position deviation of the recording medium in a width direction of the recording medium in a current job on a basis of (a) a difference between the temperature detected by the first temperature detection element and the temperature detected by the second temperature detection element before entry of a first sheet of the recording medium in the current job into the fixing unit after a start of printing for the current job, (b) a difference between the temperature detected by the first temperature detection element and the temperature detected by the second temperature detection element during passing of the recording medium through the fixing unit during the printing for the current job, and (c) information on temperature distribution on the fixing unit which occurred before the current job.

11. The image forming apparatus according to claim 10, wherein the position deviation detection unit detects the position deviation of the recording medium by comparing, with a threshold, a value determined on a basis of (a) the temperature difference before entry of the recording medium into the fixing unit, (b) the temperature difference during passing of the recording medium through the fixing unit, and (c) the information on the temperature distribution, and wherein the threshold is set in accordance with a size of the recording medium in the current job.

12. The image forming apparatus according to claim 11, wherein, the smaller the size of the recording medium, the smaller the threshold.

13. The image forming apparatus according to claim 10, wherein the first temperature detection element is provided at one end area of the fixing unit, and the second temperature detection element is provided at an opposite end area of the fixing unit in the longitudinal direction of the fixing unit.

14. The image forming apparatus according to claim 13, wherein the fixing unit includes a film that has a cylindrical shape and a heater that is in contact with an inner surface of the film, and wherein the first temperature detection element and the second temperature detection element are in contact with the heater.

15. The image forming apparatus according to claim 14, wherein the fixing unit includes a third temperature detection element for temperature control provided between the first temperature detection element and the second temperature detection element in the longitudinal direction, and wherein the third temperature detection element is in contact with the inner surface of the film.

16. The image forming apparatus according to claim 14, wherein the fixing unit includes a pressing roller configured to form, together with the heater, a fixing nip, with the film sandwiched therebetween, and wherein the recording medium with the toner image thereon undergoes fixing processing while being conveyed in a nipped state at the fixing nip.

* * * * *